US006548014B2

(12) United States Patent
Kumokita et al.

(10) Patent No.: US 6,548,014 B2
(45) Date of Patent: Apr. 15, 2003

(54) SUSPENSION APPLICATION APPARATUS AND METHOD FOR MANUFACTURING RARE EARTH MAGNET

(75) Inventors: Hiroyuki Kumokita, Ibaraki (JP); Katsumi Okayama, Kusatsu (JP); Tsuyoshi Wada, Wakayama (JP)

(73) Assignee: Sumitomo Special Metals Co., Ltd. (JP)

( * ) Notice: Subject to any disclaimer, the term of this patent is extended or adjusted under 35 U.S.C. 154(b) by 42 days.

(21) Appl. No.: 09/885,540

(22) Filed: Jun. 21, 2001

(65) Prior Publication Data

US 2002/0023583 A1 Feb. 28, 2002

(30) Foreign Application Priority Data

Jun. 21, 2000 (JP) ..... 2000-185710

(51) Int. Cl.[7] ..... B22F 7/04; B22F 3/12

(52) U.S. Cl. ..... 419/37; 419/38; 419/8; 425/78

(58) Field of Search ..... 419/38, 37, 8; 425/78

(56) References Cited

U.S. PATENT DOCUMENTS 4,863,658 A * 9/1989 Sugiura et al. ..... 264/65
5,383,978 A 1/1995 Yamamoto et al.

FOREIGN PATENT DOCUMENTS

| | | |
|---|---|---|
| JP | 61-119009 | 6/1986 |
| JP | 04-154903 | 5/1992 |
| JP | 07-161560 | 6/1995 |
| JP | 11-054353 | 2/1999 |

* cited by examiner

*Primary Examiner*—Daniel J. Jenkins
(74) *Attorney, Agent, or Firm*—Nixon Peabody LLP; Jeffrey L. Costellia

(57) ABSTRACT

A suspension application apparatus for applying a suspension containing powder particles of an oxide dispersed in a liquid to a plate for magnet sintering, the oxide having a specific gravity greater than the liquid. The apparatus includes: a container for storing the suspension; a stirrer for stirring the suspension stored in the container; a transport path through which the suspension is transported from the container to the plate; and a homogenizer for homogenizing the suspension by applying a mechanical force to at least part of the suspension flowing through the transport path.

23 Claims, 10 Drawing Sheets

SUSPENSION APPLICATION APPARATUS AND METHOD FOR MANUFACTURING RARE EARTH MAGNET

BACKGROUND OF THE INVENTION

1. Field of the Invention

The invention relates to an apparatus for applying a suspension containing oxide particles dispersed in a liquid to a plate for magnet sintering, and a method for manufacturing a rare earth magnet using such an application apparatus. More particularly, the present invention relates to an apparatus for applying a homogenized suspension to a plate, and a method for manufacturing a rare earth magnet using such an application apparatus.

2. Description of Related Art

A rare earth sintered magnet is manufactured by pulverizing an alloy for a rare earth magnet (material alloy) to produce alloy powder and compacting the alloy powder, followed by a sintering process and an aging heating process. Presently, two types of rare earth magnets, samarium-cobalt magnets and neodymium-iron-boron magnets, are widely used in various fields. In particular, neodymium-iron-boron magnets (hereinafter, referred to as R—T—(M)—B magnets where R denotes a rare earth element and/or yttrium (Y), T denotes a transition metal selected from the group consisting of iron (Fe), cobalt (Co), and nickel (Ni), M denotes an additive element, and B denotes boron or a compound of boron and carbon) have found active applications to various types of electronic equipment because the R—T—(M)—B magnets exhibit the highest maximum magnetic energy product among various other types of magnets and are comparatively inexpensive.

During the sintering process of magnet manufacturing, green compacts are mounted on a sintering plate made of a highly heat-resistant material such as stainless steel and molybdenum. The sintering plate is then placed in a sintering furnace where the green compacts are heated to a high temperature (for example, 1000 to 1100° C.) in an inert gas atmosphere. The heated compacts are sintered and shrunk to form a rare earth sintered magnet.

During the sintering process, if a green compact is directly mounted on the sintering plate, the green compact and the plate may be locally welded together. This is because a rare earth element such as Nd is used as a constituent of the R—T—(M)—B magnet and causes a eutectic reaction with a metal element contained in the plate at a temperature less than a sintering temperature. Once local welding occurs between the plate and the compact, the compact fails to shrink smoothly during the sintering, resulting in the generation of cracks and chips in the sintered body. Even if such welding between the compact and the plate does not occur, the compact may crack on the surface due to friction between the plate and the compact (sintered body). Moreover, a product from the eutectic reaction may attach to the sintering plate. In such a case, it takes time and effort to remove the attachment from the plate when the plate is reused.

In order to prevent the welding between the sintering plate and the green compact, there is conventionally known a sintering method where powder is spread over the sintering plate and green compacts are mounted on the powder spread on the sintering plate (For example, Japanese Laid-Open Patent Publication No. 4-154903). The spreading powder used is made of a material that has a low reactivity with the green compact and a good stability at high temperatures. For example, when the green compact contains a rare earth metal, the spreading powder is made of a material that has a low reactivity with the rare earth metal, such as a rare earth oxide (for example, neodymium oxide). By using such a spreading powder, it is possible to prevent welding between the plate and the green compact, and thus prevent occurrence of breakage such as cracking and deformation on the surface of the resultant rare earth magnet.

There are known methods for spreading powder on the plate, including a method where the powder is sprayed onto the plate using LP gas, a method where the powder is dispersed in a volatile dispersion medium such as ethanol and the resultant dispersion medium (i.e., suspension) is applied to the plate, and a method described in Japanese Laid-Open Patent Publication No. 11-54353, where an organic solvent such as ethanol and acetone is added to the powder made of $Dy_2O_3$ or $CaF_2$ to form a slurry, and the slurry is applied to the plate with a brush and the like.

The above conventional methods have the following problems. The method using gas to spray powder finds difficulty in spreading the powder uniformly on the plate. If the powder is not spread uniformly on the plate, a green compact may partly be welded with the plate during the sintering, and friction (resistance) between the compact and the plate occurring during shrinkage of the compact may vary with the position. These result in the compact failing to shrink uniformly. As a result, breakage (cracking and the like) and undesirable deformation are generated in the compact. In particular, when elongated, the compact fails to shrink uniformly and thus cracking and deformation are easily generated.

In the method where a suspension containing powder particles in a volatile liquid such as ethanol, or a slurry of powder with an organic solvent added thereto, is applied to the plate with a brush and the like, the work of applying the suspension or the slurry to the plate is time-consuming, and thus the productivity is low. In addition, in order to spread powder uniformly on the plate, the suspension or the slurry must be applied to the plate in the form of a thin layer. Applying such a suspension or slurry uniformly to the plate is difficult.

In the case of dispersing a powder of a rare earth oxide and the like in a volatile liquid such as ethanol, the powder is easily separated from the liquid in the suspension because the difference in specific gravity between the volatile liquid and the powder particles is comparatively large (for example, the specific gravity of ethanol is 0.8 while that of $R_2O_3$ (rare earth oxide) is 7 to 8). Using such a suspension, it is difficult to maintain a uniform concentration of the powder particles in the entire suspension. Therefore, even if the suspension is successfully applied uniformly to the plate, the concentration of the applied suspension often varies with position. It is therefore difficult to spread powder particles uniformly on the plate by applying such a suspension. If uniform spreading of powder fails, the resultant sintered body tends to have breakage and undesirable deformation.

Moreover, in the case of automatically applying a suspension or a slurry to the plate from a tank via a pipe or the like, the pipe may possibly become clogged. In particular, for intermittent application with stops interposed between plates, the supply of the suspension or the slurry is temporarily stopped or delayed. This causes poor flowability of the suspension or the slurry in the pipe, and thus the powder particles in the suspension or the slurry tend to settle, resulting in clogging of the pipe.

SUMMARY OF THE INVENTION

A main object of the present invention is to provide an application apparatus capable of applying a suspension containing powder particles (spreading powder particles) of an oxide dispersed in a liquid to a sintering plate uniformly without clogging a transport path such as a pipe and a tube with the suspension, to enable uniform spreading of the oxide powder on the plate.

Another object of the present invention is to provide a method for manufacturing a rare earth magnet where oxide particles are spread uniformly on a sintering plate using the application apparatus described above so that cracks or the like are not generated in the green compacts mounted on the plate during sintering.

The suspension application apparatus of the present invention is an apparatus for applying a suspension containing powder particles of an oxide dispersed in a liquid to a plate for magnet sintering, where the powder particles have a specific gravity greater than the liquid. The apparatus includes a container for storing the suspension; a stirrer for stirring the suspension stored in the container, a transport path through which the suspension is transported from the container to the plate, and a homogenizer for homogenizing the suspension by applying a mechanical force to at least part of the suspension flowing through the transport path.

In a preferred embodiment, the homogenizer generates unsteady flow in the at least part of the suspension flowing through the transport path.

In a preferred embodiment, the unsteady flow is a flow in the direction opposite to the direction from the container toward the plate.

In a preferred embodiment, the suspension application apparatus further includes a discharge path connected to the transport path for enabling discharge of the suspension flowing in the opposite direction.

In a preferred embodiment, the homogenizer can jet a fluid into the suspension flowing through the transport path.

In a preferred embodiment, the fluid is air.

In a preferred embodiment, the suspension application apparatus further includes a discharge path connected to the transport path for enabling discharge of at least part of the fluid.

In a preferred embodiment, the discharge path extends as far as the inside of the container.

In a preferred embodiment, the homogenizer can generate unsteady flow in at least part of the suspension in the vicinity of a connection between the transport path and the container.

In a preferred embodiment, the suspension application further includes a metering pump provided at a position of the transport path downstream of the homogenizer.

In a preferred embodiment, the suspension application apparatus further includes a spreading device for spreading the suspension supplied to the surface of the plate over the surface.

In a preferred embodiment, the spreading device includes an absorptive roller provided to come in contact with the surface of the plate.

In a preferred embodiment, the homogenizer applies a mechanical force to the transport path.

In a preferred embodiment, the homogenizer swings the transport path.

In a preferred embodiment, the suspension application apparatus further includes a plate cleaner for cleaning the plate prior to the application of the suspension, wherein the plate cleaner includes a powder shooter for allowing powder to impinge against the plate and a swinger for swinging the powder shooter, and the homogenizer is connected with the swinger of the plate cleaner, so that the transport path is swung with the movement of the swinger.

In a preferred embodiment, the suspension application apparatus further includes a nozzle connected to an end of the transport path, a gas supply path connected to the nozzle, wherein the suspension is sprayed onto the plate using a gas supplied to the nozzle through the gas supply path.

In a preferred embodiment, the liquid is volatile.

In a preferred embodiment, the powder particles of an oxide comprises powder particles of a rare earth oxide.

The method for manufacturing a rare earth magnet of the present invention includes the steps of preparing a plate for magnet sintering, applying a suspension containing powder particles of an oxide in a liquid to the plate using any of the suspension application apparatus described above, mounting a green compact produced by compacting alloy powder for a rare earth magnet on the plate to which the suspension has been applied, and sintering the green compact mounted on the plate.

In a preferred embodiment, the surface roughness Rmax of the plate is in a range of 1 $\mu$m to 300 $\mu$m.

In a preferred embodiment, the surface roughness Ra of the plate is in a range of 0.1 $\mu$m to 150 $\mu$m.

In a preferred embodiment, the concentration of the suspension is in a range of 200 g/L to 500 g/L.

The method for manufacturing a rare earth magnet of the present invention includes the steps of: preparing a plate for magnet sintering; applying a suspension containing powder particles of an oxide dispersed in a liquid to the plate, the powder particles having a specific gravity greater than the liquid; mounting a green compact produced by compacting alloy powder for a rare earth magnet on the plate to which the suspension has been applied; and sintering the green compact mounted on the plate. The surface roughness Rmax of the plate is in a range of 1 $\mu$m to 300 $\mu$m.

The method for manufacturing a rare earth magnet of the present invention includes the steps of: preparing a plate for magnet sintering; applying a suspension containing powder particles of an oxide dispersed in a liquid to the plate, the powder particles having a specific gravity greater than the liquid; mounting a green compact produced by compacting alloy powder for a rare earth magnet on the plate to which the suspension has been applied; and sintering the green compact mounted on the plate. The surface roughness Ra of the plate is in a range of 0.1 $\mu$m to 150 $\mu$m.

In a preferred embodiment, the concentration of the suspension is in a range of 200 g/L to 500 g/L.

In a preferred embodiment, the average particle size of the powder particles is in a range of 1 $\mu$m to 20 $\mu$m.

As used herein, the term "suspension" refers to a suspension obtained by dispersing powder in a liquid, including the state where powder particles is scattered in the liquid in a nonuniform manner and the state where part of the powder particles is settled out.

BRIEF DESCRIPTION OF THE DRAWINGS

FIG. 2A shows a flow during normal operation and FIG. 2B shows a flow during air supply.

DETAILED DESCRIPTION OF THE INVENTION

Detailed Description of the Invention Hereinafter, preferred embodiments of the present invention will be described with reference to the accompanying drawings.

(Embodiment 1)

Figure 1:
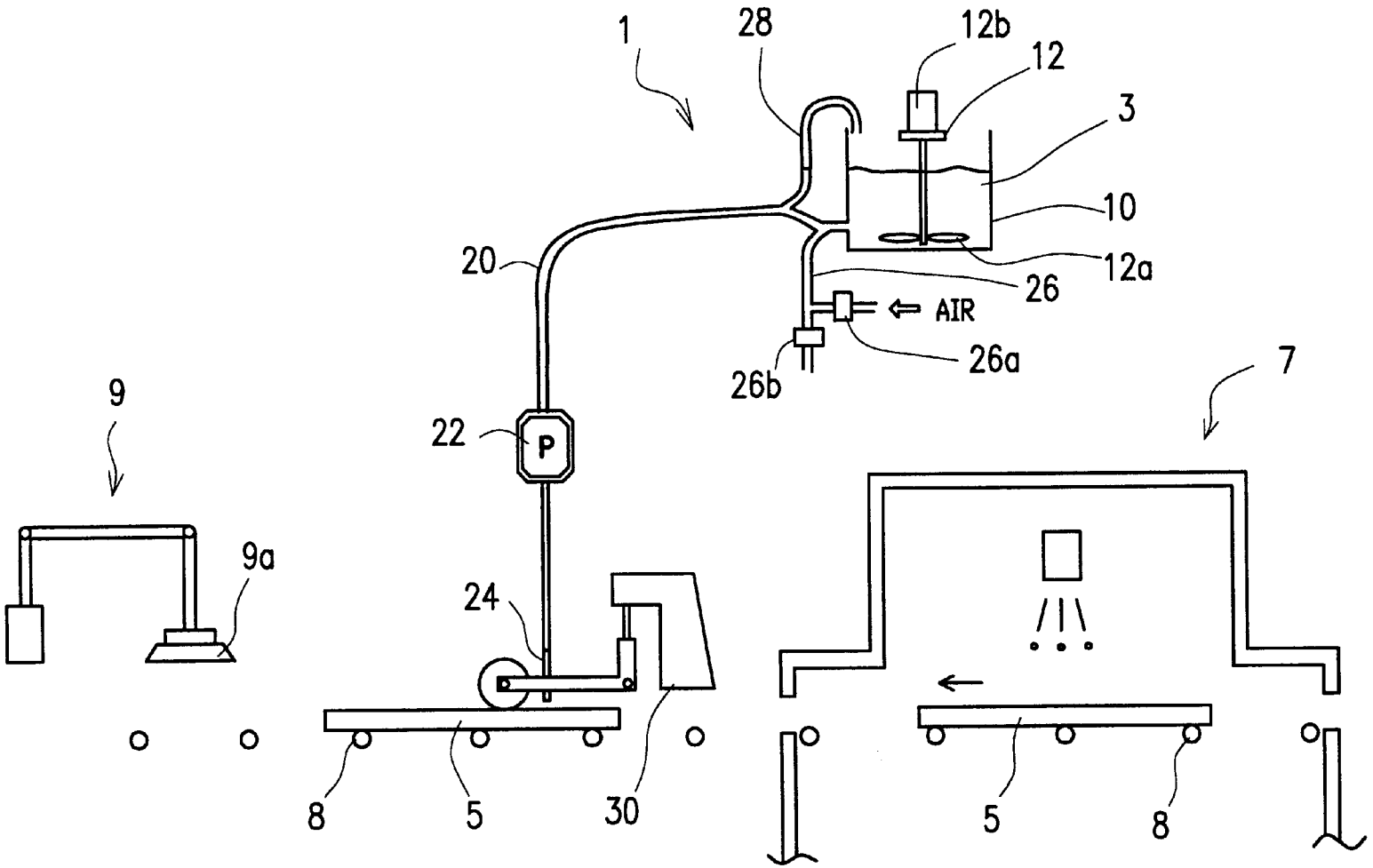
FIG. 1 is a structural view of the suspension application apparatus of Embodiment 1 of the present invention.

Referring to FIG. 1, a suspension application apparatus 1 of this embodiment is placed in the vicinity of a shot blaster 7 for cleaning the surface of a sintering plate 5. The shot blaster 7 shoots powder of alumina and the like to allow the powder to impinge against the surface of the plate 5 to remove attachments on the surface of the plate 5. The plate 5 with the surface cleaned is then conveyed to a position at which application of a suspension is performed, with a conveyor 8 constructed of a plurality of rollers and the like. At this position, the suspension application apparatus 1 applies a suspension containing spreading powder particles dispersed in a liquid to the surface of the plate 5. The plate 5 with the suspension applied thereto by the suspension application apparatus 1 is then conveyed to a robot 9 including a suction device 9*a* and the like. The plate 5 is then stored with other plates by being stacked one on the other in a predetermined place preferably after the suspension-applied surface of the plate 5 has been dried. Thereafter, the plate 5 is conveyed to a position (not shown) where green compacts are mounted on the plate 5.

The suspension application apparatus 1 includes: a tank 10 storing a suspension 3 containing powder particles of an oxide such as a rare earth oxide in a volatile liquid such as alcohol; a transport tube 20 for transporting the suspension 3 from the tank 10 to the plate 5; and a spreading device 30 capable of spreading the suspension 3 over the plate 5.

The tank 10 of the suspension application apparatus 1 is provided with a stirrer 12 for stirring the suspension 3 stored in the tank 10. The stirrer 12 includes blades 12*a* that are located near the bottom of the tank 10 and rotated at a rotational speed of 180 rpm, for example, with a motor 12*b* through a stirring rod. The suspension 3 is stirred by the rotation of the blades 12*a*, so that the oxide powder particles (spreading powder) in the suspension 3 is prevented from settling.

The transport tube 20 is connected with the tank 10 at a position near the bottom of the tank 10 to be in fluid communication with the tank 10. The top end of the transport tube 20 extending from the tank 10 is connected with a nozzle 24 via a metering pump 22. The nozzle 24 is placed so that it is positioned above the plate 5 when the plate 5 is conveyed to a predetermined position. The metering pump 22 pumps the suspension 3 from the tank 10 in a predetermined flow and enables the suspension 3 to drop onto the plate 5 via the nozzle 24. The amount of the suspension 3 dropped onto the plate 5 (time interval between drops) is adjusted by adjusting the flow of the suspension 3, which is done by adjusting the output of the metering pump 22 or by deforming the transport tube 20 in a radial direction (e.g. by mechanically pinching the transport tube 20).

An air supply tube 26 is connected with the transport tube 20 at a position near the connection between the transport tube 20 and the tank 10 to allow compressed air to be intermittently released into the suspension 3 flowing in the transport tube 20. This air supply to the transport tube 20 is controlled with the open/close operation of a solenoid valve 26*a* disposed somewhere between the source of compressed air and the air supply tube 26. A drain 26*b* is connected to the air supply tube 26 so that the entire suspension 3 in the tank 10 can be drained off by opening a valve thereof during the maintenance of the apparatus and the like. In normal operation, the drain 26*b* is not used when the valve is closed.

A discharge tube 28 is connected to the transport tube 20 at a position between the air supply tube 26 and the metering pump 22. The other end of the discharge tube 28 is located inside the tank 10.

Figure 2A:
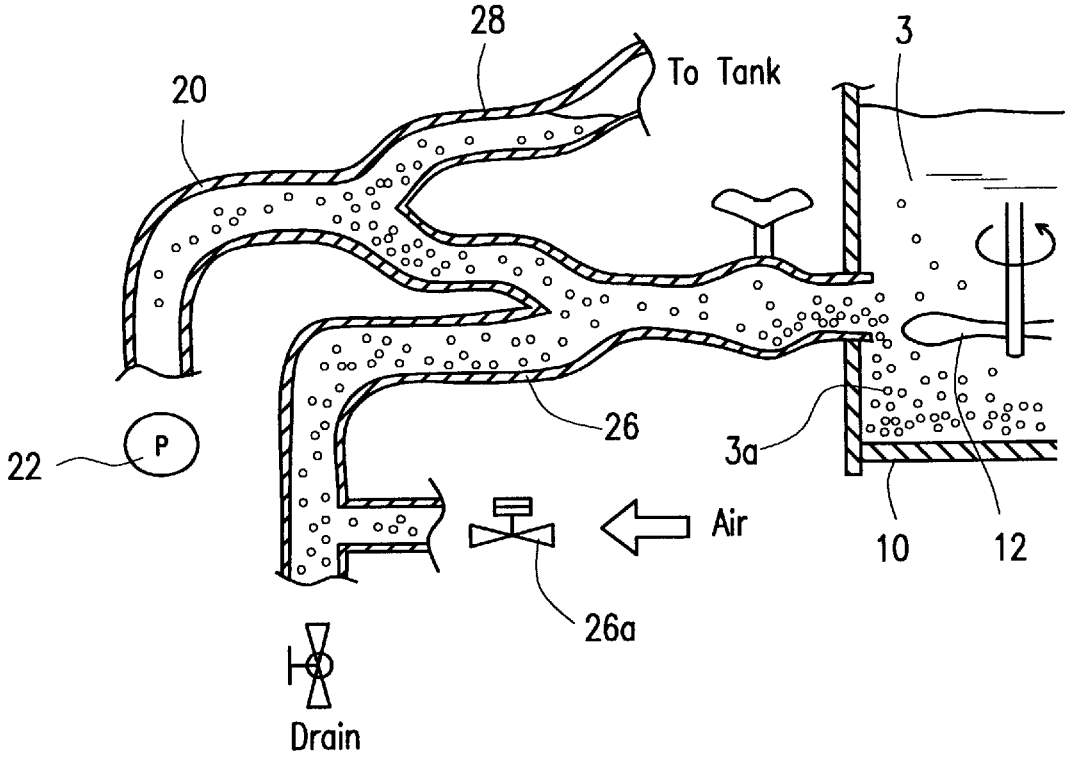
FIGS. 2A and 2B are cross-sectional views illustrating a change of flow of a suspension flowing in a transport tube, where
Figure 2B:
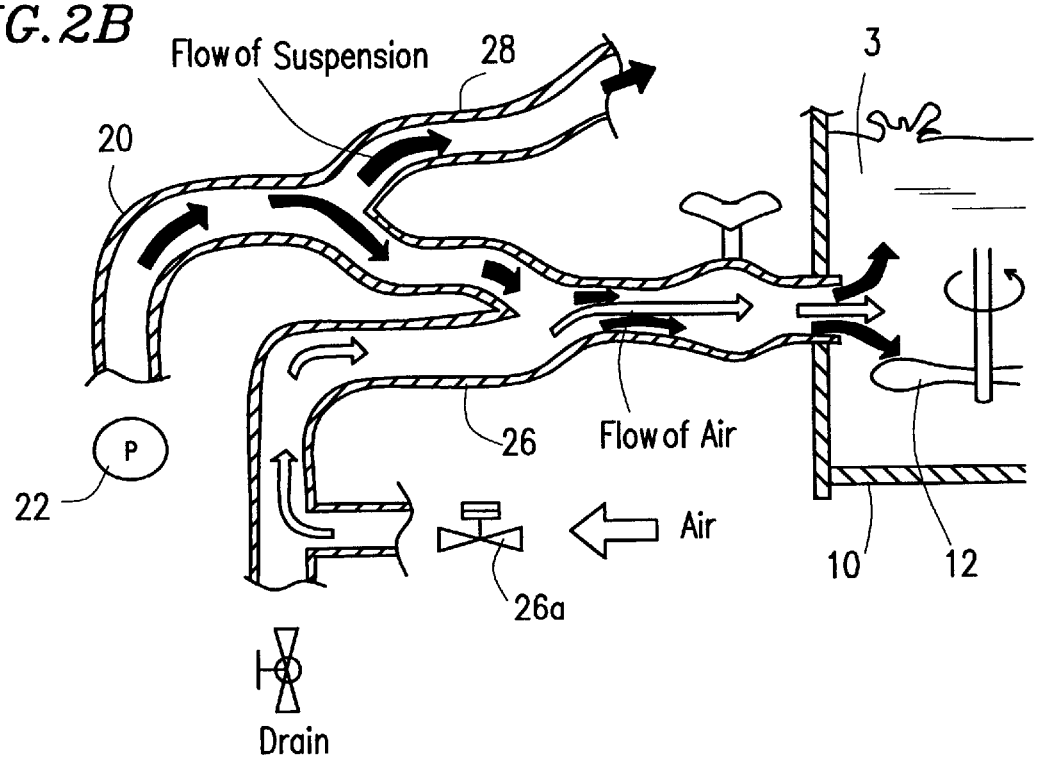

FIG. 2A and 2B describe how the flow of the suspension 3 in the transport tube 20 changes with supply of air from the air supply tube 26.

In the state shown in FIG. 2A in which no air is supplied, the metering pump 22 pumps the suspension 3 and the suspension 3 flows through the transport tube 20 from the tank 10 toward the metering pump 22 in the steady state.

The suspension 3 in the tank 10 is invariably stirred with the stirrer 12. However, it is difficult to stir the entire suspension 3 in the tank 10. At and near the bottom of the tank 10, oxide powder particles 3*a* tend to settle, or, if not settled, the concentration of the oxide powder particles 3*a* becomes very high.

In the above case, the oxide powder particles 3*a* are sometimes deposited in the transport tube 20 near the outlet of the tank 10 at the connection between the transport tube 20 and the tank 10. This deposition of the oxide powder particles 3*a* tends to occur when the amount of the suspension 3 dropped onto the plate 5 with the metering pump 22 is small and thus the flow rate of the suspension 3 flowing in the transport tube 20 is comparatively slow. As the amount of the deposited powder particles 3*a* gradually increases, the transport tube 20 will finally be clogged resulting in failure of proper supply of the suspension 3. In addition, during the flowing of the suspension 3 in the transport tube 20, the powder particles 3*a* may be deposited in the transport tube 20 at positions where the suspension 3 flows especially slowly. In such a case, also, the transport tube 20 may possibly be clogged with the deposited powder particles 3*a*.

In order to solve the above problem, air is intermittently jet from the air supply tube 26 into the transport tube 20. The flow of the air is indicated by the open arrows in FIG. 2B. By this air jet, it is possible to generate unsteady reverse flow (backflow) of the suspension 3 that is different from the steady flow present before the air jet. This flow of the suspension 3 is indicated by the black arrows in FIG. 2B. Preferably, the air is jet toward the tank 10 through the transport tube 20 as shown in FIG. 2B. This forces the oxide powder particles 3*a* deposited at the connection between the transport tube 20 and the tank 10, that is, the position at which the powder particles is most easily deposited, back into the tank 10. This also enables the oxide powder particles 3*a* settled on the bottom of the tank 10 to be dispersed in the suspension 3, so that the suspension can be stirred.

The air supply described above generates reverse flow of the suspension 3 from the nozzle 24 toward the tank 10 in the entire transport tube 20. Preferably, the rate of this reverse flow can be set greater than the rate of the steady flow. With this reverse flow, the oxide powder particles 3*a* deposited or staying in the transport tube 20 can be moved or dispersed in the suspension 3, and thus the transport tube 20 is prevented from being clogged with the powder particles 3*a*. In addition, the suspension 3 in the transport tube 20 can be homogenized. Therefore, it is possible to prevent the concentration of the suspension 3 dropped onto the plate 5 via the nozzle 24 from changing with time.

Thus, in this embodiment, air is supplied into the transport tube 20 to force the suspension 3 flowing in the transport tube 20 to change the flowing direction, so that uneven distribution of the powder particles 3*a* in the suspension 3 is eliminated. In this way, the suspension 3 is homogenized.

The oxide powder particles 3*a* deposited in the transport tube 20 are moved by the flow of the suspension 3 back toward the tank 10. During this backflow, part of the suspension 3 is discharged through the discharge tube 28. With the provision of the discharge tube 28, through which the backflow of the suspension 3 partly flows, the suspension 3 is avoided from being in an excessively negative pressure near the metering pump 22 and the like, and thus the backflow from the metering pump 22 toward the tank 10 can be easily generated.

The discharge tube 28 has another function of exhausting any of the air supplied from the air supply tube 26 that may possibly head toward the metering pump 22, such as air that has failed to head toward the tank 10 and air remaining inside the transport tube 20. Air is therefore prevented from reaching the metering pump 22 and thus from blocking the operation of the metering pump 22, which therefore can drop a predetermined amount of suspension 3 onto the plate 5 via the nozzle 24 during the application operation.

The suspension and the air discharged from the discharge tube 28 are returned to the tank 10 as shown in FIG. 1. This enables reuse of the discharged suspension and thus avoids waste.

When backflow of the suspension 3 is generated by the air supply, the suspension 3 is drawn back from the nozzle 24, preventing the suspension 3 from dropping onto the plate 5. Therefore, the air supply is desirably performed during the period other than the period of the application operation for the plate 5 (for example, period after completion of the application operation for one plate and before arrival of the next plate to the application apparatus 1).

Figure 3:
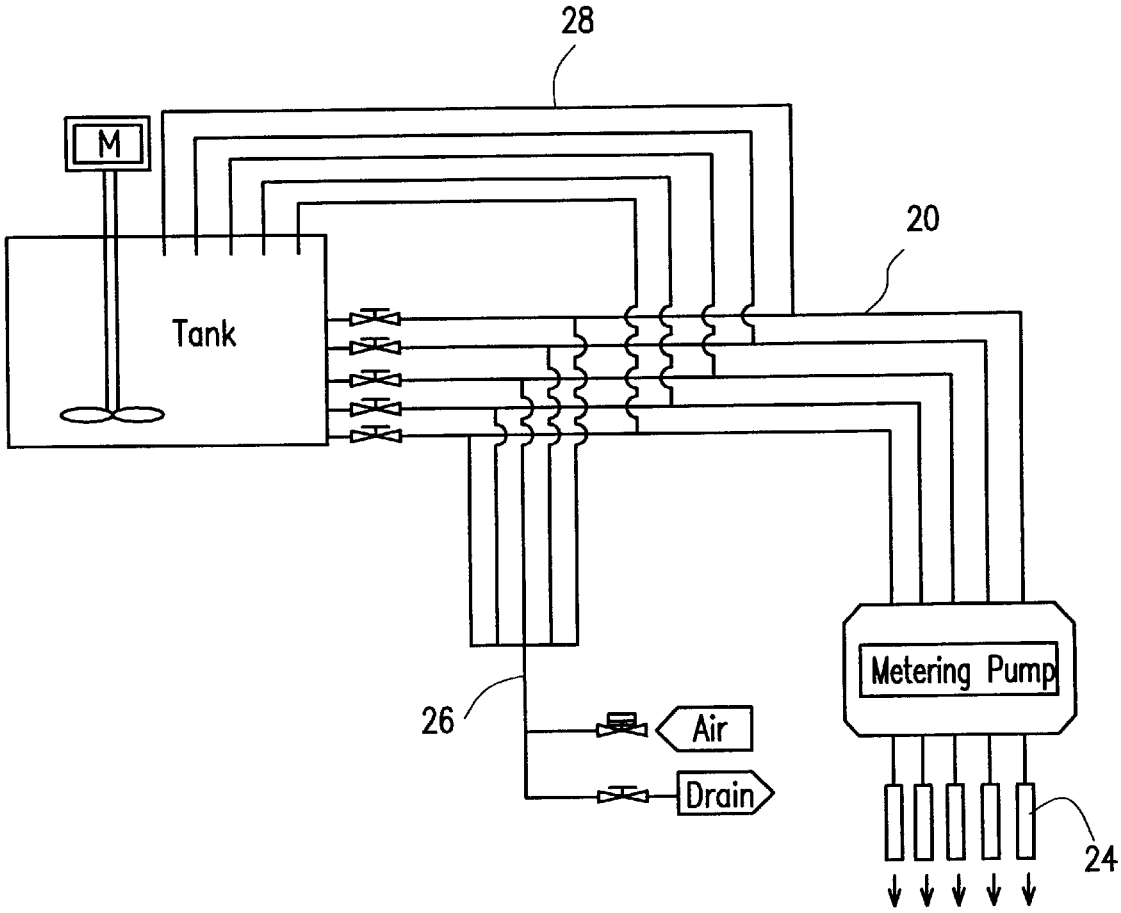
FIG. 3 is a diagram of a tube connection in the case of using a plurality of transport tubes.

FIG. 3 illustrates a connection of a plurality of transport tubes 20 and the like in the case that the suspension is applied to the plate from the plurality of transport tubes 20 via a plurality of nozzles 24. By connecting air supply tubes 26 and discharge tubes 28 with the transport tubes 20 as shown in FIG. 3, air can be supplied to the transport tubes 20 through the air supply tubes 26, and the suspension and the air can be discharged through the discharge tubes 28. In this way, powder particles deposited in the transport tubes 20 can be properly removed or dispersed. Thus, it is possible to prevent generation of clogging and nonuniform concentration of the suspension in the respective transport tubes.

Figure 4:
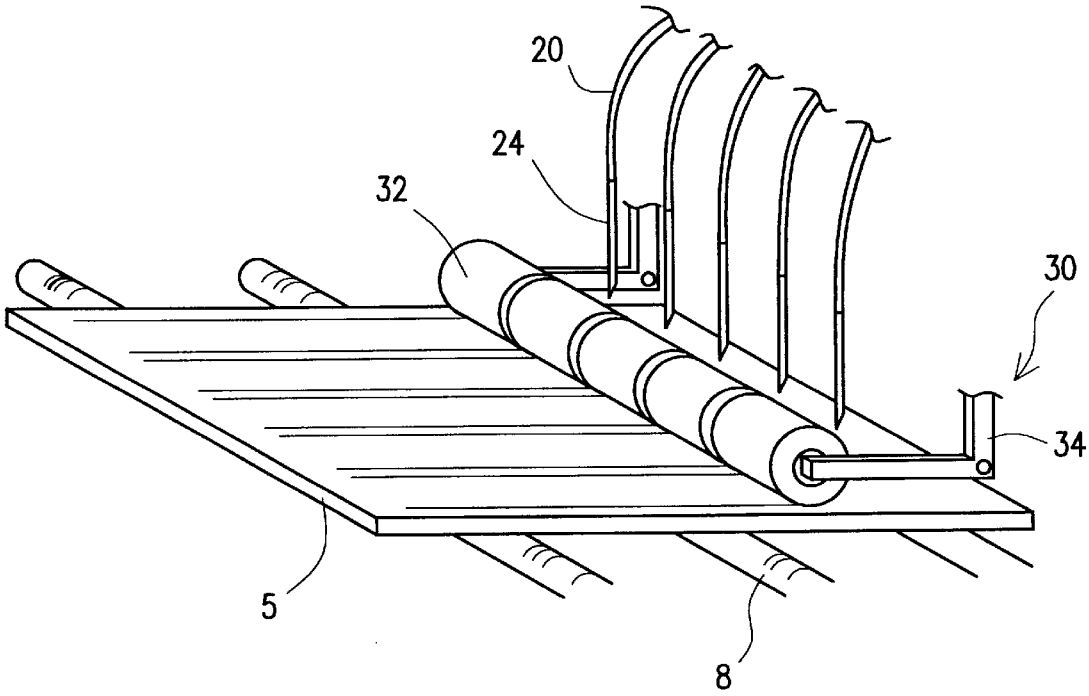
FIG. 4 is a perspective view illustrating application of the suspension to a sintering plate.

FIGS. 4 and 5 describe the spreading device 30 for spreading the dropped suspension over the plate.

The spreading device 30 shown in FIG. 4 includes a plurality of rollers 32 provided for the respective nozzles 24 for applying the suspension dropped via the plurality of nozzles 24 over the plate 5. Note that the illustrated spreading device 30 including the plurality of rollers 32 arranged in parallel is for the case that regions of the plate 5 on which green compacts are to be mounted are limited and application of the suspension is required only for these limited regions. In the case that application of the suspension is required for the entire surface of the plate, for example, one roller having a length corresponding to the entire width of the plate or the like may be used.

Each of the rollers 32 is desirably designed so that it is attached to a fixed member 34 to be movable upward and downward within a predetermined range and placed on the plate 5 by its own weight. The surface of the roller 32 is preferably made of an absorptive material such as felt.

Figure 5A:
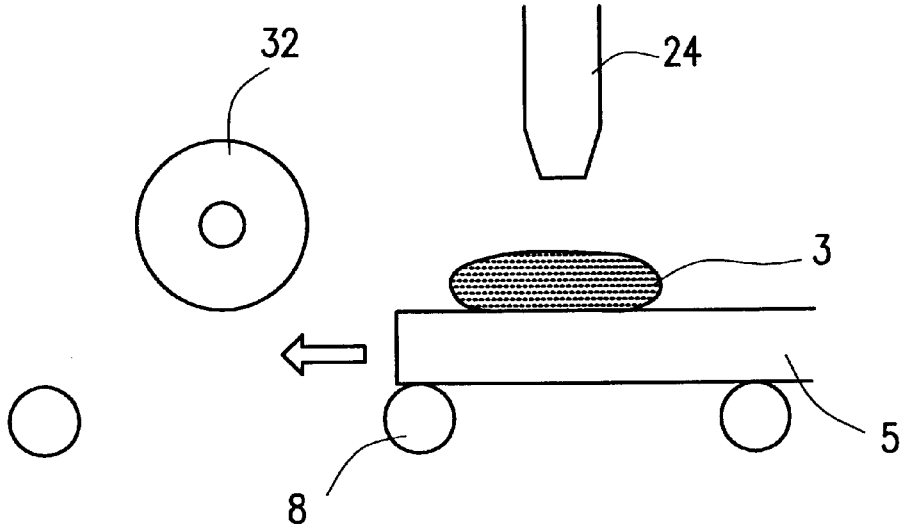
FIGS. 5A and 5B are enlarged cross-sectional views illustrating the application of the suspension to the sintering plate.
Figure 5B:
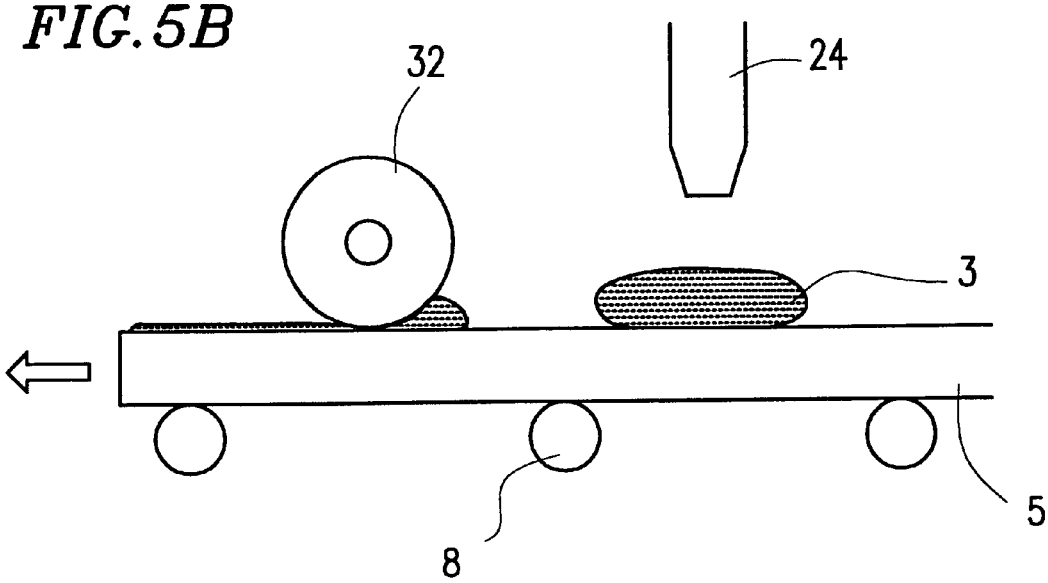

Referring to FIG. 5A, after the suspension 3 is dropped onto the plate 5 via the nozzle 24, the plate 5 is moved toward the roller 32 with the conveyor 8. Referring to FIG. 5B, the roller 32 having the absorptive surface spreads the suspension 3 over the plate 5 to a uniform thickness while absorbing excessive part of the suspension 3. Since the roller 32 is placed on the plate 5 by its own weight, it is possible to apply the suspension 3 to the plate 5 to a uniform thickness even when the plate itself has a deformation such as a slight warp and a variation in thickness. Also, in the case of continuous application to a plurality of plates 5, the suspension 3 can be applied to the plurality of plates 5 to a uniform thickness even when the thickness of the plates 5 more or less varies.

According to the suspension application apparatus 1 of the present invention, it is possible to apply a suspension containing powder particles in a comparatively uniform concentration to a plate at a uniform thickness while preventing clogging of a tube with settled or unevenly distributed powder particles even when the suspension contains powder particles of an oxide such as a rare earth oxide dispersed in a liquid such as alcohol.

Hereinafter, a flow of operation of the suspension application apparatus will be described with reference to FIGS. 6 and 7.

Figure 6:
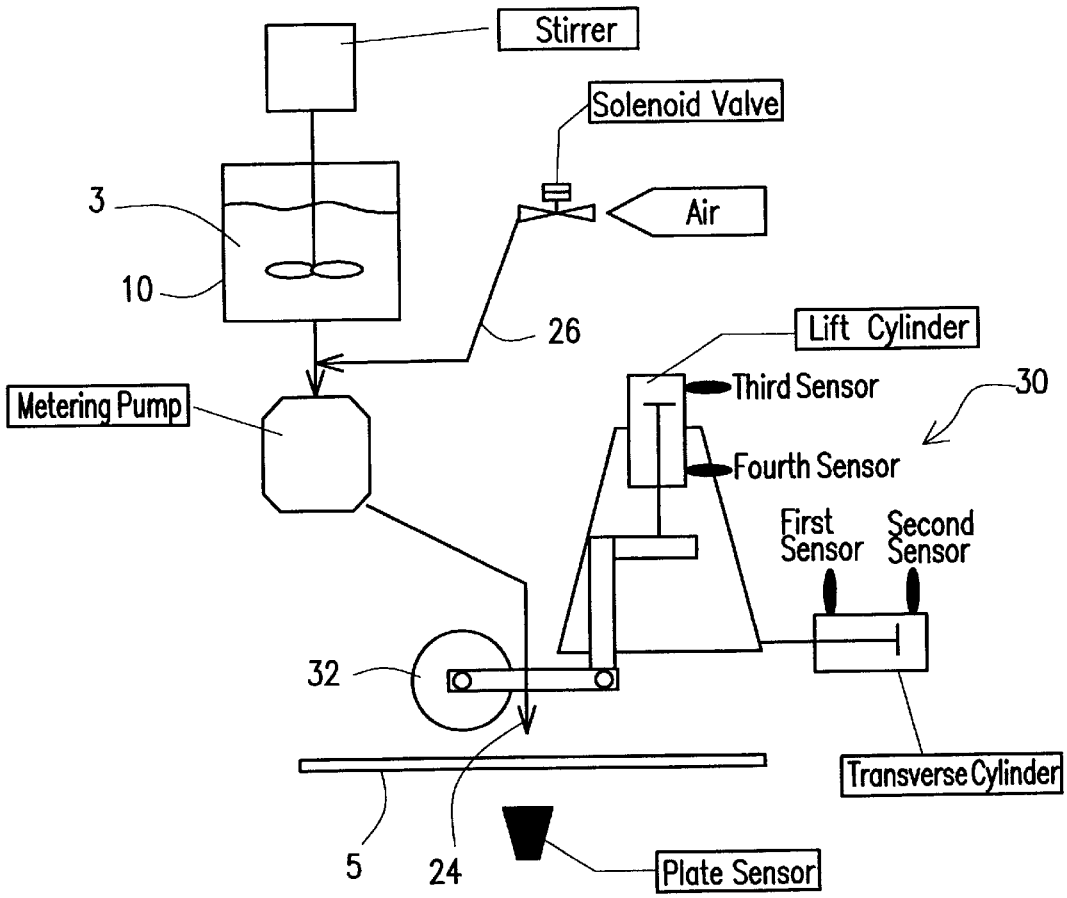
FIG. 6 is a schematic view of the suspension application apparatus of Embodiment 1.

Referring to FIG. 6, the suspension application apparatus includes: the stirrer provided for the tank 10, the metering pump for transporting the suspension 3 from the tank 10 to the plate 5, and the spreading device 30 including the roller 32 for spreading the suspension 3 over the plate 5.

The spreading device 30 is connected to a transverse cylinder for transverse movement of the spreading device 30. The transverse cylinder includes a first sensor for detecting arrival of the spreading device 30 at an advance position and a second sensor for detecting arrival of the spreading device 30 at a retreat position.

The roller 32 of the spreading device 30 is connected to a lift cylinder for vertical movement of the roller 32. The lift cylinder includes a third sensor for detecting arrival of the roller 32 at a rise position and a fourth sensor for detecting arrival of the roller 32 at a fall position.

The suspension application apparatus also includes a plate sensor for detecting whether or not the plate 5 conveyed with the conveyor 8 (see FIG.1) is present at a predetermined position on the conveying route.

Figure 7:
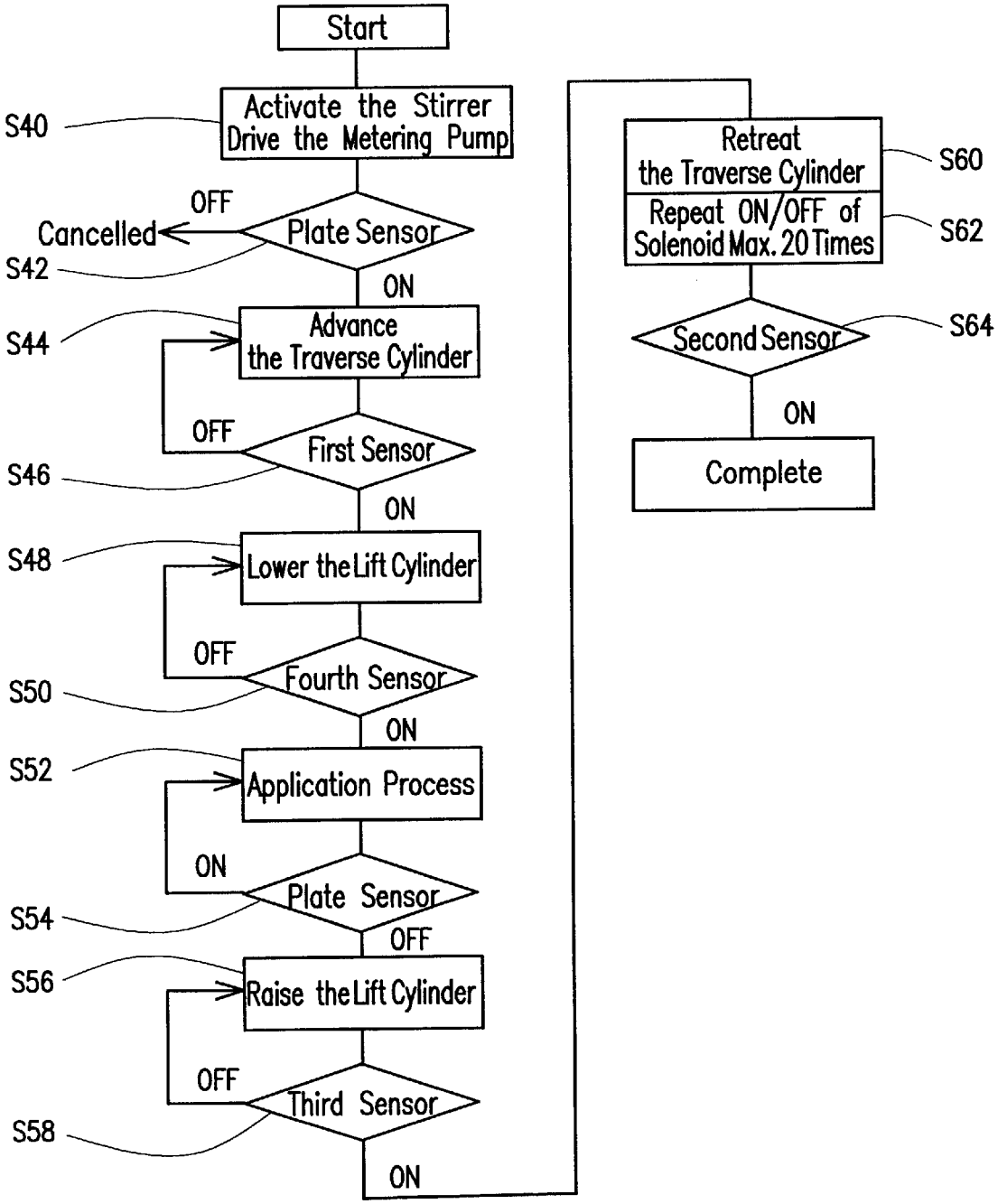
FIG. 7 is a flowchart of the operation of the suspension application apparatus shown in FIG. 6.

Referring to FIG. 7, in the suspension application apparatus with the above construction, dispensed amounts of a dispersion medium and oxide powder at a predetermined ratio are put in the tank 10, and the stirrer is activated (step S40). While suspension is being stirred, the metering pump starts to be driven to allow the suspension 3 transported from the tank 10 to be dropped via the nozzle 24.

Once the plate sensor detects arrival of the plate 5 at the predetermined position (step S42), the spreading device 30 is moved to its advance position with the transverse cylinder (step S44). When the first sensor detects arrival of the spreading device 30 at the advance position (step S46), the roller 32 is moved to its fall position with the lift cylinder (step S48). Arrival of the roller 32 at the fall position is detected by the fourth sensor connected to the lift cylinder (step S50).

The suspension 3 dropped on the plate 5 can be spread properly when the spreading device 30 has arrived at the advance position and the roller 32 has arrived at the fall position. If the spreading device 30 is in the advance position during processes other than the application process, the spreading device 30 may block movement of the plate. For example, when the plate is moved to another position with the robot 9 (see FIG. 1) after the application process, the spreading device 30 may block the movement. Also, if the roller 32 is in the fall position when no plate is present, the roller 32 may possibly come into contact with the conveyor 8 (see FIG. 1) resulting in wearing of the roller 32. Note that when the spreading device 30 and the roller 32 are moved as described above, the nozzle 24 via which the suspension 3 is dropped is desirably secured to a roller support member to keep the relative position thereof with respect to the roller 32 unchanged.

By moving the roller 32 to the position as described above and conveying the plate 5 with the conveyor 8, the suspension is spread on the plate 5 (step S52). This application of the suspension 3 is continued until the plate sensor determines that the plate 5 is no longer present (that is, until the suspension has been applied to the entire plate) (step S54). After the application process, the roller 32 is lifted to the rise position using the lift cylinder and the third sensor is attached to the lift cylinder (steps S56 and S58). The spreading device 30 is then retreated with the transverse cylinder (step S60).

At that time, the open/close operation of the solenoid valve 26*a* attached to the air supply tube 26 is repeated a plurality of times (20 times at maximum) to supply air into the transport tube intermittently (step S62). With this air supply, unsteady backflow of the suspension is generated to allow oxide powder particles settled in the transport tube to be dispersed.

The metering pump is operating throughout the air supply. However, with the backflow of the suspension generated in the transport tube, the suspension is prevented from dropping via the nozzle 24. For this reason, the air supply process (step S62) comes after completion of the process of application of the suspension to the plate (step S54) as described above.

Thereafter, the second sensor detects arrival of the spreading device 30 at the retreat position (step S64), to complete one cycle of the application operation. When another plate to be processed is conveyed to the position of the application apparatus with the conveyor, the application apparatus returns to step S42 to be ready for the application operation for the next plate.

(Embodiment 2)

A suspension application apparatus 201 of Embodiment 2 of the present invention will be described with reference to the relevant drawings. In the drawings, like components as those of the suspension application apparatus of Embodiment 1 are denoted by the same reference numerals.

Figure 8:
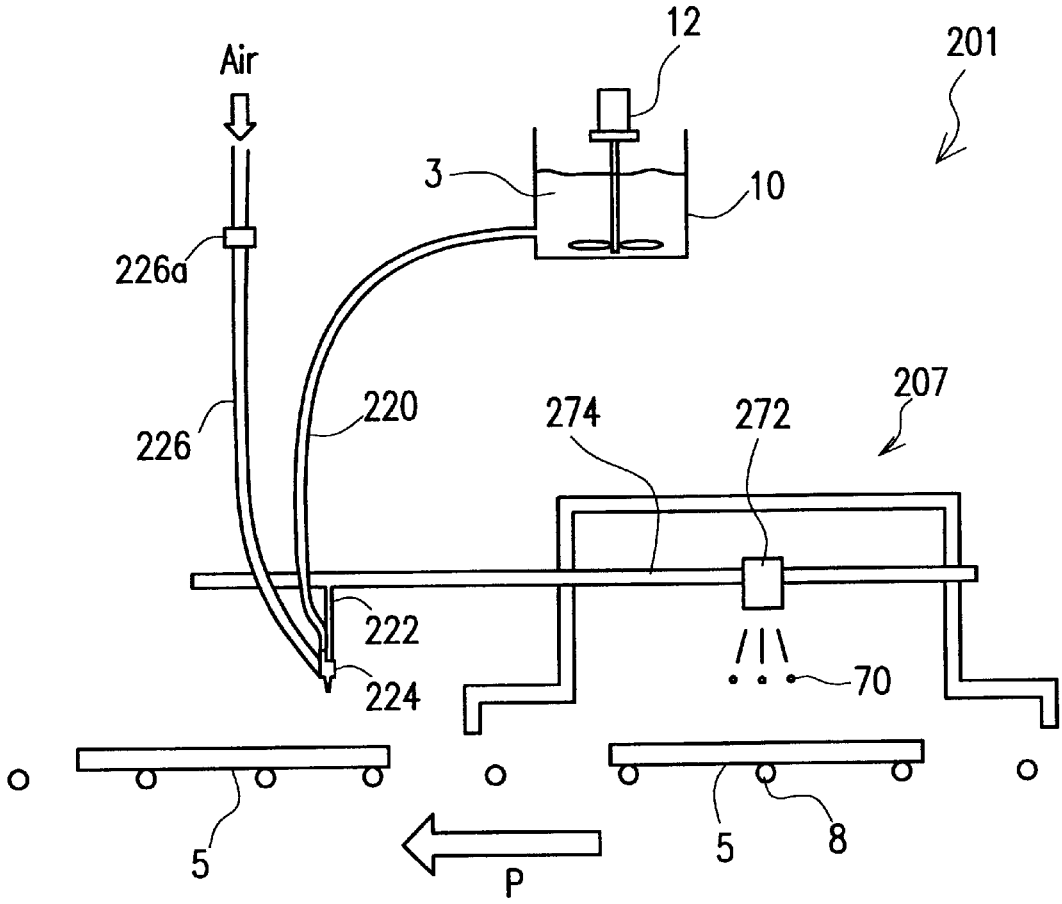
FIG. 8 is a structural view of the suspension application apparatus of Embodiment 2 of the present invention.

Referring to FIG. 8, the suspension application apparatus 201 of Embodiment 2 includes: a tank 10 storing a suspension 3 containing powder particles of an oxide such as a rare earth oxide dispersed in a volatile liquid such as alcohol; a transport tube 220 for transporting the suspension 3 from the tank 10 to a plate 5; and a nozzle 224 connected to the end of the transport tube 220 (the end opposite to that connected to the tank 10). The tank 10 is provided with a stirrer 12 for stirring the suspension 3 as in Embodiment 1.

An air supply tube 226 having a valve 226*a* is connected to the nozzle 224 to supply air to the nozzle 224 by opening the valve 226*a*. With this air supply, the suspension 3 can be jet or sprayed onto the plate 5 via the nozzle 224. The bore of the jet outlet of the nozzle 224 is 2 mm, for example, and the discharge pressure of the suspension 3 from the nozzle 224 is 2 kg/cm$^2$, for example. As such a nozzle that jets the suspension upon receipt of air supply, a Lumina automatic spray gun PR series manufactured by Fuso Seiki Co., Ltd. is usable, for example.

The suspension application apparatus 201 is placed in the vicinity of a shot blaster 207 for cleaning the surface of the sintering plate 5. The shot blaster 207 includes a powder shooting device 272 for shooting powder 70 made of alumina and the like to allow the powder 70 to impinge against the top surface of the plate 5 that is moved in the direction of arrow P with a conveyor 8. The powder shooting device 272 is secured to a shaft 274 extending in the direction of the movement of the plate 5. The shaft 274 can be rotated with a rotation device (not shown) in the two opposite directions, and with the rotation of the shaft 274, the powder shooting device 272 can be swung around the shaft 274. The powder shooting device 272 shoots powder while being swung during the movement of the plate 5. In this way, the shot blaster 207 cleans the entire top surface of the plate 5.

Figure 9:
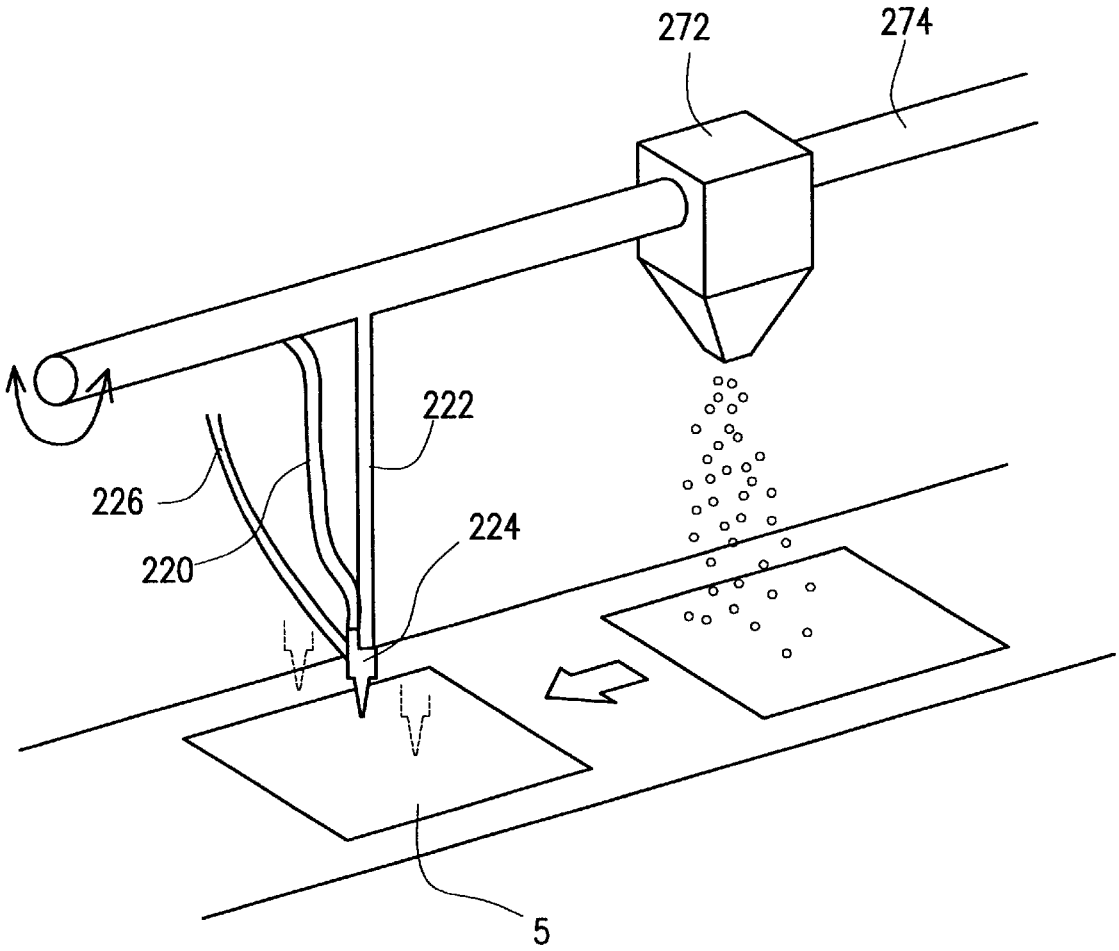
FIG. 9 is a perspective view illustrating part of the suspension application apparatus shown in FIG. 8.
Figure 10:
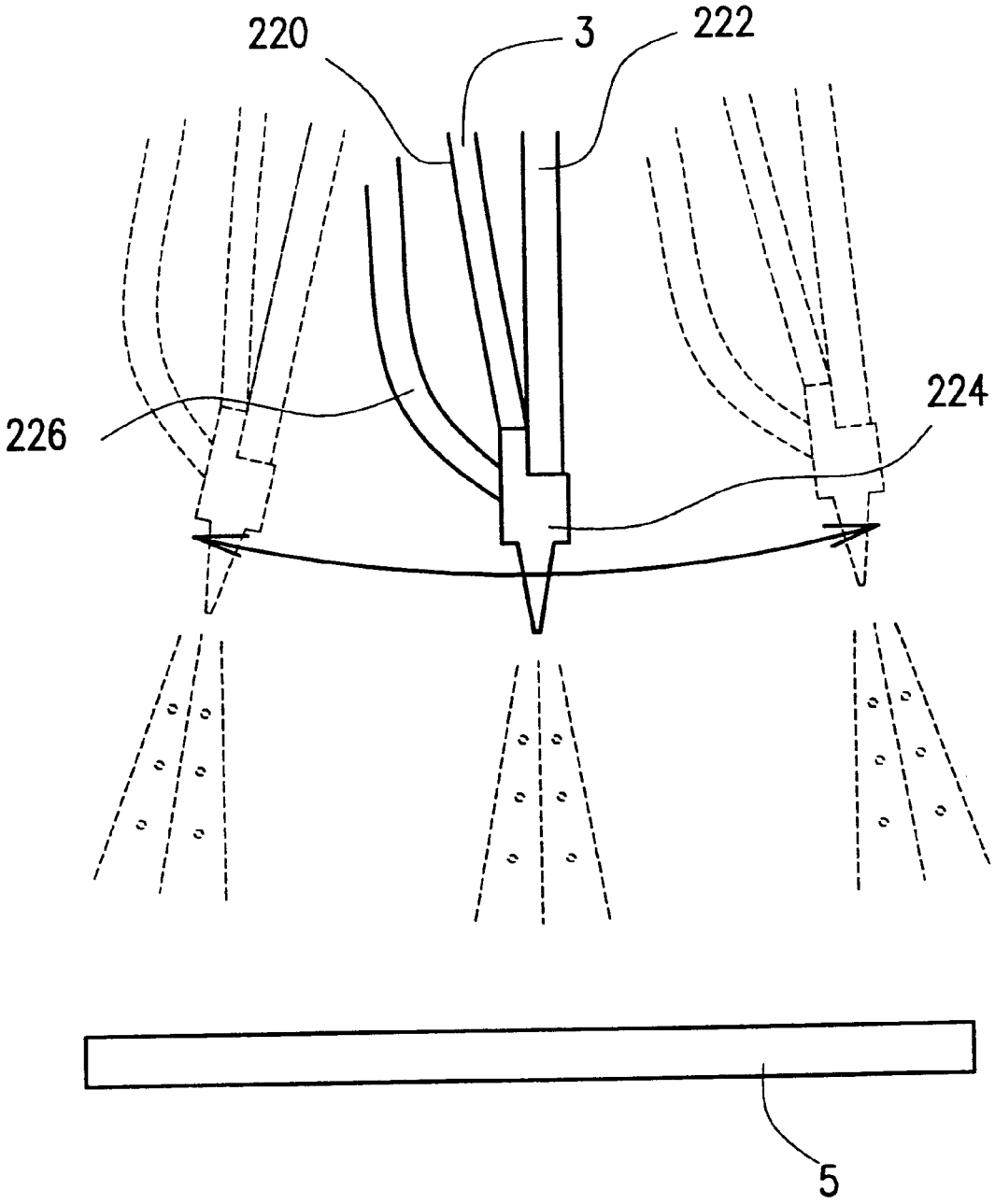
FIG. 10 is an enlarged front view illustrating the application of a suspension to a sintering plate using the suspension application apparatus shown in FIG. 8.

Referring to FIG. 9, the nozzle 224 for jetting the suspension 3 onto the plate 5 is also secured to the shaft 274 via an arm 222. Therefore, when the shaft 274 is rotated to swing the powder shooting device 272, the nozzle 224 is also swung. As shown in FIG. 10, by this swing, the nozzle 224 is moved at the position above the plate 5 in a direction roughly orthogonal to the direction of the movement of the plate 5, and thus the suspension 3 is sprayed over the entire top surface of the plate 5.

During the above spraying, the transport tube 220 for transporting the suspension 3 to the nozzle 224 is also swung together with the movement of the nozzle 224. By this swing, a mechanical force is applied to the suspension 3 flowing in the transport tube 220, enabling spreading powder particles in the suspension 3 to move inside the transport tube 220. This homogenizes the suspension 3, and also prevents clogging of the transport tube 220 due to uneven distribution of the spreading powder particles in the suspension 3.

A device (not shown) for vibrating the transport tube 220 may be provided to ensure prevention of settlement of spreading powder particles in the transport tube 220. Preferably, such a vibrating device may effectively vibrate a portion of the transport tube 220 where spreading powder particles especially tends to be settled. For example, the vibrating device may be placed in the vicinity of the connection between the tank 10 and the transport tube 220.

In this embodiment, the suspension 3 is jet via the nozzle 224 all the time. That is, the suspension 3 is jet even when the plate 5 is not present under the nozzle 224 in the continuous application of the suspension 3 to a plurality of plates 5. Nevertheless, it is still preferable to continue jetting the suspension 3 in consideration of prevention of clogging of the transport tube 22.

[Method for Manufacturing Rare Earth Sintered Magnet]

Hereinafter, a method for manufacturing a R—T—(M)—B rare earth sintered magnet using the suspension application apparatus 1 or 201 described above will be described.

For manufacture of a R—T—(M)—B magnet, an ingot of a R—T(M)—B alloy is first produced by strip casting. Strip casting is disclosed in U.S. Pat. No. 5,383,978, for example. Specifically, an alloy having a composition of Nd: 30 wt %, B: 1.0 wt %, Al: 0.2 wt %, Co: 0.9 wt %, Cu: 0.2 wt %, and Fe and inevitable impurities as the remainder is melted by high-frequency melting to form a molten alloy. The molten alloy is kept at 1350° C. and then rapidly cooled by a single roll method, to obtain alloy flakes having a thickness of about 0.3 mm. The rapid cooling is performed under the conditions of a roll circumferential velocity of about 1 m/sec, a cooling rate of 500° C. sec, and supercooling to 200° C.

The resultant alloy flakes are roughly pulverized by hydrogen occlusion, and then finely milled with a jet mill in a nitrogen gas atmosphere, to produce alloy powder having an average particle size of about 3.5 μm.

A lubricant, 0.3 wt %, is added to and mixed with the thus-produced alloy powder in a rocking mixer so that the alloy powder particles are coated with the lubricant. A fatty ester diluted with a petroleum-based solvent is preferable for the lubricant. In this embodiment, preferably, methyl caproate can be used as the fatty ester and isoparaffin can be used as the petroleum-based solvent. The weight ratio of methyl caproate to isoparaffin may be 1:9, for example.

Thereafter, the resultant alloy powder is compacted with a press in a magnetic field, to produce a green compact in a predetermined shape. The density of the green compact is set at about 4.3 g/cm$^3$, for example.

On the other hand, a sintering plate on which the green compact is to be mounted is prepared. The sintering plate is produced of a metal having a high melting point such as stainless steel and molybdenum. Preferably, it is produced of molybdenum. Molybdenum is suitable as the material of the sintering plate because it is low in the reactivity with a green compact containing a rare earth metal element and good in heat conductivity and heat resistance.

As will be discussed later, an oxide powder having an average particle size in the range of 1 μm to several tens of micrometers (more preferably, 1 μm to 20μm) is preferable as the spreading powder to be spread on the sintering plate. When oxide powder having such a particle size is used, the sintering plate desirably has an average surface roughness Ra in the range of 0.1 μm to 150 μm, more desirably in the range of 0.1 μm to 10.0 μm. If the average surface roughness Ra is less than 0.1 μm, the unevenness of the plate surface is so small that the powder particles move (slide) on the plate. As a result, it is difficult to spread the powder uniformly on the plate. If the average surface roughness Ra exceeds 150 μm, the unevenness of the plate surface is so large that the powder particles fail to function as the spreading powder particles. Therefore, the friction between the plate and the green compact becomes large, and as a result, cracks may be generated in the green compact, if welding can be avoided during sintering. The maximum surface roughness Rmax is desirably in the range of 0.1 μm to 300 μm for the same reason. The surface roughnesses Ra and Rmax can be measured according to JIS using a small-size surface roughness measuring instrument (Surftest SJ-301) manufactured by Mitutoyo Corporation, for example.

As the sintering plate is used repeatedly, the surface roughness of the plate gradually may increase for reasons such as that residuals are left unremoved on the plate after sintering. However, as long as the plate has an average roughness Ra of 150 μm or less and a maximum roughness Rmax of 300 μm or less, cracking of the sintered body can be properly prevented by spreading the spreading powder on the plate. Alternatively, the size of the spreading powder may be changed depending on the level of the surface roughness of the plate.

To the sintered plate described above, a suspension containing oxide powder particles dispersed in a liquid is applied uniformly using the suspension application apparatus 1 or 201. As the dispersion medium (liquid), a volatile liquid such as ethanol and methanol is desirably used. By using a volatile liquid, it is possible to reduce the time required to dry the plate after the application of the suspension to the plate. Ethanol is especially preferred because it is relatively inexpensive. The oxide powder is desirably made of a material that is stable at a sintering temperature and low in the reactivity with a green compact containing a rare earth metal element. Examples of such a material include rare earth oxides such as neodymium oxides and yttrium oxides and oxides such as zirconia and alumina.

The average particle size of oxide powder used as the spreading powder is desirably in the range of 1 μm to several tens of micrometers. If the particle size of the powder is less than 1 μm, the powder may possibly be buried in concave portions of the surface of the plate, failing to function as the spreading powder. If the particle size exceeds several tens of micrometers, the powder may fail to be dispersed uniformly in the suspension. In addition, when using spreading powder having an excessively large particle size, the transport tube of the suspension application apparatus tends to be clogged with the spreading powder. The average particle size of the oxide powder is preferably in the range of 1 μm to 20 μm, and more preferably in the range of 1 μm to 10 μm.

The concentration of the suspension is desirably 10 g/L or more (10 g or more of powder in 1 liter of a dispersion medium). If the concentration is less than 10 g/L, the amount of powder spread on the plate is relatively small, possibly failing to obtain the effect as the spreading powder. Also, the concentration of the suspension is desirably 500 g/L or less. If the concentration is excessively high, the transport tube of the application apparatus tends to be clogged. In addition, an unnecessarily large amount of powder will be consumed. The concentration of the suspension is more preferably in the range of 200 g/L to 500 g/L.

After the application of the suspension using the suspension application apparatus 1 or 201, the dispersion medium, which is preferably volatile, is evaporated. In this way, the oxide powder particles in the suspension are spread on the sintering plate as the spreading powder. The use of the suspension application apparatus 1 or 201 saves time and effort that would otherwise be required, permitting shortening of the application process time, and moreover enables uniform spreading of the powder on the plate.

A number of green compacts produced in the manner described above are mounted on the sintering plate with the spreading powder spread thereon. A plurality of such sintering plates with green compacts mounted thereon are stacked one on the other with a space formed therebetween using spacers, and such stacks of sintering plates are stored in a sintering case. A sintering case is constructed of a box with an opening and a lid covering the opening, for example. Using this sintering case, the green compacts are prevented from being sintered in an unprotected state in a sintering furnace. If no sintering case is used, a rare earth element in the green compacts may possibly be oxidized with oxygen existing in the furnace. This greatly deteriorates the properties of the resultant magnet.

The sintering case is conveyed to a sintering apparatus. First, the sintering case is put in a preparatory chamber located at the entrance of the sintering apparatus. The preparatory chamber is then hermetically sealed and evacuated to an ambient pressure of about 2 pascals for prevention of oxidation. The sintering case is then conveyed to a debindering chamber where debindering (temperature: 250 to 600° C., pressure: 2 pascals, duration: 3 to 6 hours) is performed to volatilize a lubricant (binder) covering the surface of magnetic powder prior to sintering. The lubricant has been mixed in the magnetic powder prior to the compaction for improving the orientation of the magnetic powder during the compaction, and exists between particles of the magnetic powder. During the debindering, various gases such as organic gas and vapor are generated from the green compacts. Therefore, a getter capable of absorbing such gases is desirably placed in the sintering case in advance.

After completion of the debindering, the sintering case is conveyed to a sintering chamber to be subjected to sintering at 1000 to 1100° C. for about 2 to 5 hours in an argon atmosphere. During the sintering, since the spreading powder has been spread on the sintering plate uniformly using the suspension application apparatus 1 or 201 as described above, the green compacts are prevented from being welded with the plate, and the possibility of cracking and damaging the resultant sintered body is reduced. In addition, the shrinkage of the green compacts, which occurs during the sintering, is uniform since the spreading powder has been spread uniformly on the plate. Thus, undesirable deformation of the green compacts is prevented.

Thereafter, the sintering case is conveyed to a cooling chamber, where the sintering case is cooled until the temperature of the sintering case becomes as low as room temperature. The cooled sintered body is then put in an aging furnace to be subjected to a normal aging process, which is performed at a temperature of 400 to 600° C. under a pressure of an atmospheric gas such as argon of about 2 pascals for about 3 to 7 hours, for example.

The method for manufacturing a rare earth sintered magnet according to the present invention is not only applied to the magnet having the composition described above, but widely applicable to R—T(M)—B magnets suitably. For example, materials containing, as the rare earth element R, at least one type selected from Y, La, Ca, Pr, Nd, Sm, Gd, Tb, Dy, Ho, Er, Tm, and Lu may be used. To ensure sufficient magnetization, either one or both of Pr and Nd preferably occupy 50 at % or more of the rare earth element R. If the content of the rare earth element R is 10 at % or less, the coercive force decreases due to precipitation of α-Fe phase. If the content of the rare earth element R exceeds 20 at % , a large amount of a R-rich second phase is precipitated in addition to the target tetragonal $Nd_2Fe_{14}B$ compounds, resulting in reduction in magnetization. Therefore, the content of the rare earth element R is preferably in the range of 10 to 20 at %.

T denotes a transition metal element including Fe, Co, and Ni. If the content of T is less than 67 at %, a second phase that is low in both coercive force and magnetization is precipitated, resulting in deterioration in magnetic properties. If the content of T exceeds 85 at %, the coercive force decreases due to precipitation of α-Fe phase and the squareness of a demagnetization curve deteriorates. Therefore, the content of T is preferably in the range of 67 to 85 at %. T may be composed of Fe only, but addition of Co raises the Curie temperature and thus improves the heat resistance. Fe preferably occupies 50 at % or more of T. If the occupation of Fe is less than 50 at %, the saturation magnetization of the $Nd_2Fe_{14}B$ compound itself is reduced.

B denotes boron or a compound of boron and carbon, which is indispensable for stable precipitation of the tetragonal $Nd_2Fe_{14}B$ crystal structure. If the addition of B is less than 4 at %, the coercive force decreases due to precipitation of $R_2T_{17}$ phase, and the squareness of a demagnetization curve is significantly impaired. If the addition of B exceeds 10 at %, a second phase that is low in magnetization is precipitated. Therefore, the content of B is preferably in the range of 4 to 10 at %.

An addition element M may be provided for improving the magnetic nature of the powder and for improving the corrosion resistance. As the addition element M, preferably usable is at least one type selected from the group consisting of Al, Ti, Cu, V, Cr, Ni, Ga, Zr, Nb, Mo, In, Sn, Hf, Ta, and W. Such an addition element M may not be added at all. When added, the amount is preferably 10 at % or less. If it exceeds 10 at %, a second phase that is not ferromagnetic is precipitated, resulting in reduction in magnetization.

Although the method for manufacturing a R—T—(M)—B sintered magnet was described, it is also possible to manufacture a samarium-cobalt sintered magnet using the sintering plate with spreading powder uniformly spread thereon by the suspension application apparatus 1 or 201 described above. Thus, in the manufacture of a rare earth sintered magnet in which a liquid phase is generated during sintering, welding of the sintered body with the plate is prevented, and thus breakage and deformation of the sintered body can be prevented, by using the sintering plate on which spreading powder has been uniformly spread by use of the suspension application apparatus 1 or 201.

(EXAMPLE 1)

R—Fe—B sintered magnets, 400 samples, having a size of 57.2 mm×44.7 mm×18.4 mm (weight: 335 g) were manufactured using a sintering plate on which spreading powder (oxide powder) has been spread by use of the suspension application apparatus 1 of Embodiment 1. As the sintering plate, a plate member made of an Mo alloy (surface roughness Ra: 0.1 μm) was used. As the spreading powder, used was powder of a rare earth oxide represented by $R_2O_3$ having an average particle size of 3 μm. The powder of a rare earth oxide, 150 g, was dispersed in 3 liters of ethanol in the tank 10 of the suspension application apparatus 1. The output of the pump 22 and the like were set so that the discharge pressure of the suspension at the nozzle 24 of the suspension application apparatus 1 was 2 kg/cm$^2$.

The sintering was performed at a temperature of 1045° C. in an argon atmosphere. As a result, cracking was found in one sample among the 400 sintered bodies. Significant deformation was recognized in two samples among the 400 samples.

(COMPARATIVE EXAMPLE 1)

R—Fe—B sintered magnets, 400 samples, were manufactured under the same conditions as those adopted in Example 1 except that no spreading powder was spread on the plate. As a result, cracking was found in 20 samples among the 400 sintered bodies.

Likewise, R—Fe—B sintered magnets, 400 samples, were manufactured under the same conditions as those adopted in Example 1 except that the application of the suspension to the plate was made manually not using the suspension application apparatus 1. As a result, significant deformation was found in 4 samples among the 400 sintered bodies.

(EXAMPLE 2)

R—Fe—B sintered magnets, 400 samples, having a size of 57.2 mm×44.7 mm×18.4 mm (weight: 335 g) were manufactured using a sintering plate on which spreading powder (oxide powder) has been spread by use of the suspension application apparatus 201 of Embodiment 2.

Two plate members made of an Mo alloy were used as the sintering plate: a sintering plate (plate 1) having an average surface roughness Ra of 0.1 μm and a maximum surface roughness Rmax of 1 μm; and a sintering plate (plate 2) having an average surface roughness Ra of 150 μm and a maximum surface roughness Rmax of 300 μm.

As the spreading powder, powder of an Nd oxide having an average particle size of 1 μm was used. The rare earth oxide powder, 300 g, was dispersed in 1 liter of ethanol in the tank 10 of the suspension application apparatus 1. Air was supplied to the nozzle 224 of the suspension application apparatus 201 so that the discharge pressure of the suspension at the nozzle 224 was 2 kg/cm$^2$.

The sintering was performed at a temperature of 1045° C. in an argon atmosphere. As a result, cracking was found in none of the 400 sintered bodies when the plate 1 was used, and found in one sample among the 400 sintered bodies when the plate 2 was used.

(Comparative Example 2)

R—Fe—B sintered magnets, 400 samples, were manufactured under the same conditions as those adopted in Example 2 except that a sintering plate having a comparatively large surface roughness (Ra>150 μm, Rmax>300 μm), that is, an average surface roughness Ra of 200 μm and a maximum surface roughness Rmax of 400 μm. As a result, cracking was found in 10 samples among the 400 sintered bodies.

From the results of Example 2 and Comparative Example 2, it is found that by appropriately setting the surface roughness of the sintering plate, the function of the spreading powder can be derived effectively, and thus generation of cracking of the sintered body can be greatly reduced.

According to the suspension application apparatus of the present invention, a suspension containing powder particles of an oxide such as a rare earth oxide dispersed in a liquid can be applied to the sintering plate homogeneously. This enables uniform spreading of the spreading powder on the sintering plate.

By using the sintering plate with the spreading powder spread uniformly, the green compacts mounted on the sintering plate are prevented from breakage and deformation during the sintering.

While the present invention has been described in a preferred embodiment, it will be apparent to those skilled in the art that the disclosed invention may be modified in numerous ways and may assume many embodiments other than that specifically set out and described above. Accordingly, it is intended by the appended claims to cover all modifications of the invention that fall within the true spirit and scope of the invention.

What is claimed is:

1. A suspension application apparatus for applying a suspension containing powder particles of an oxide dispersed in a liquid to a plate for magnet sintering, the powder particles having a specific gravity greater than the liquid, the apparatus comprising:

a container for storing the suspension;

a stirrer for stirring the suspension stored in the container;

a transport path through which the suspension is transported from the container to the plate; and a homogenizer for homogenizing the suspension by applying a mechanical force to at least part of the suspension flowing through the transport path.

2. A suspension application apparatus according to claim 1, wherein the homogenizer generates unsteady flow in the at least part of the suspension flowing through the transport path.

3. A suspension application apparatus according to claim 2, wherein the unsteady flow is a flow in a direction opposite to the direction from the container toward the plate.

4. A suspension application apparatus according to claim 3, further comprising a discharge path connected to the transport path for enabling discharge of the suspension flowing in the opposite direction.

5. A suspension application apparatus according to claim 4, wherein the discharge path extends as far as the inside of the container.

6. A suspension application apparatus according to claim 2, wherein the homogenizer can release a fluid into the suspension flowing through the transport path.

7. A suspension application apparatus according to claim 6, wherein the fluid is air.

8. A suspension application apparatus according to claim 6, further comprising a discharge path connected to the transport path for enabling discharge of at least part of the fluid.

9. A suspension application apparatus according to claim 8, wherein the discharge path extends as far as the inside of the container.

10. A suspension application apparatus according to claim 2, wherein the homogenizer can generate the unsteady flow in the at least part of the suspension in the vicinity of a connection between the transport path and the container.

11. A suspension application apparatus according to claim 2, further comprising a metering pump provided at a position of the transport path downstream of the homogenizer.

12. A suspension application apparatus according to claim 2, further comprising a spreading device for spreading the suspension supplied to a surface of the plate over the surface.

13. A suspension application apparatus according to claim 12, wherein the spreading device comprises an absorptive roller provided to come into contact with the surface of the plate.

14. A suspension application apparatus according to claim 1, wherein the homogenizer applies a mechanical force to the transport path.

15. A suspension application apparatus according to claim 14, wherein the homogenizer swings the transport path.

16. A suspension application apparatus according to claim 15, further comprising a plate cleaner for cleaning the plate prior to the application of the suspension, wherein the plate cleaner comprises a powder shooter for allowing powder to impinge against the plate and a swinger for swinging the powder shooter, and the homogenizer is connected with the swinger of the plate cleaner, so that the transport path is swung with the movement of the swinger.

17. A suspension application apparatus according to claim 14, further comprising: a nozzle connected to an end of the transport path; and a gas supply path connected to the nozzle, wherein the suspension is sprayed onto the plate using a gas supplied to the nozzle through the gas supply path.

18. A suspension application apparatus according to claim 1, wherein the liquid is volatile.

19. A suspension application apparatus according to claim 1, wherein the powder particles of the oxide comprises powder particles of a rare earth oxide.

20. A method for manufacturing a rare earth magnet, comprising the steps of:

preparing a plate for magnet sintering;

applying a suspension containing powder particles of an oxide in a liquid to the plate using the suspension application apparatus according to claim 1;

mounting a green compact produced by compacting alloy powder for a rare earth magnet on the plate to which the suspension has been applied; and sintering the green compact mounted on the plate.

21. A method for manufacturing a rare earth magnet according to claim 20, wherein the surface roughness Rmax of the plate is in a range of 1 $\mu$m to 300 $\mu$m.

22. A method for manufacturing a rare earth magnet according to claim 20, wherein the surface roughness Ra of the plate is in a range of 0.1 $\mu$m to 150 $\mu$m.

23. A method for manufacturing a rare earth magnet according to claim 20, wherein the concentration of the suspension is in a range of 200 g/IL to 500 g/L.

* * * * *